United States Patent [19]

Kida

[11] Patent Number: 5,056,775

[45] Date of Patent: Oct. 15, 1991

[54] DOCUMENT FEEDER WHICH PROPERLY POSITIONS A DOCUMENT ON THE PLATEN

[75] Inventor: Yasuhiko Kida, Osaka, Japan

[73] Assignee: Mita Industrial Co., Ltd., Japan

[21] Appl. No.: 548,851

[22] Filed: Jul. 6, 1990

[30] Foreign Application Priority Data

Jul. 12, 1989 [JP] Japan ..... 1-180059
Jul. 12, 1989 [JP] Japan ..... 1-180060

[51] Int. Cl.[5] ..... B65H 7/14

[52] U.S. Cl. ..... 271/227; 271/3; 271/265

[58] Field of Search ..... 271/227, 258, 259, 265, 271/3

[56] References Cited

U.S. PATENT DOCUMENTS

| | | | |
|---|---|---|---|
| 4,455,018 | 6/1984 | Colglazier et al. | 271/265 |
| 4,621,799 | 11/1986 | Bastow et al. | 271/227 |
| 4,713,674 | 12/1987 | Giezeman et al. | 271/227 |
| 4,791,451 | 12/1988 | Hirose et al. | 271/227 |
| 4,825,248 | 4/1989 | Honjo et al. | 271/265 |
| 4,939,676 | 7/1990 | Worsley et al. | 271/258 |
| 4,982,228 | 1/1991 | Watanabe | 271/265 |

FOREIGN PATENT DOCUMENTS

| | | | |
|---|---|---|---|
| 118640 | 7/1984 | Japan | 271/227 |
| 167168 | 7/1987 | Japan | 271/227 |
| 41341 | 2/1988 | Japan | 271/265 |
| 53963 | 3/1989 | Japan | 271/227 |

OTHER PUBLICATIONS

Avritt, M. D., "Document Feeder with Center Referencing", *IBM Technical Disclosure Bulletin*, vol. 24, No. 9, pp. 4612 (2-1982).

*Primary Examiner*—Robert P. Olszewski
*Assistant Examiner*—Steve Reiss
*Attorney, Agent, or Firm*—Beveridge, DeGrandi & Weilacher

[57] ABSTRACT

An automatic document feeder includes a document delivery belt for conveying a document, a pulse output switch for supplying pulses in synchronism with driving of the belt, and a counter for counting the number of the pulses supplied. The extent that the delivery belt is driven is roughly controlled on the basis of the number of pulses supplied from the pulse output switch. After a predetermined number of pulses have been provided, the driving of the delivery belt is controlled according to time. According to the time control, the delivery belt is driven for a constant time period. The number of the pulses supplied during this constant time period is counted. If the counted value is different from a predetermined reference value, the delivery belt is driven until the counted value reaches the reference value. The delivery belt is thus controlled to accurately set the document in a predetermined position.

7 Claims, 7 Drawing Sheets

DOCUMENT FEEDER WHICH PROPERLY POSITIONS A DOCUMENT ON THE PLATEN

BACKGROUND OF THE INVENTION

1. Field of the Invention

The present invention relates to an automatic document feeder attached to a copying apparatus and the like, and automatically setting documents in a predetermined position. More specifically, the invention relates to an automatic document feeder for conveying documents by means of a conveyer delivery belt.

2. Description of the Prior Art

There has been known an automatic document feeder including a function to convey documents by means of a delivery belt.

When setting a document, the automatic document feeder of this type is adapted to control timing to drive or to brake the delivery belt so as to set the document with its leading or trailing edge placed on the reference line.

However, there is a drawback that if the delivery belt is merely braked at a predetermined timing, a halt position shifts according to various sizes of the document.

There is also known a document feeder adopting a method, wherein for the purpose of setting the trailing edge of the document more accurately on the reference line, the document runs a little bit over a setting position, and then the delivery belt is reversed to switch back the document and to make the document edge bump against a protruded portion disposed on the reference line.

With this method, however, the document edge bumps against the protruded portion for positioning and therefore, the document is apt to suffer damages such as edge bending.

This is because when the delivery belt conveys the document, a contact ratio of the delivery belt to the conveyance path surface, e.g. contact glass, varies according to size or kinds of the document.

Normally, the surface of the delivery belt is made rough to give a large friction coefficient. Accordingly, in the case of carrying small sized documents, a large force for driving the delivery belt is required because the contact area of the delivery belt to the conveyance path surface is large. As opposed to this, the larger the document conveyed, the smaller the contact area of delivery belt to the conveyance path surface, requiring the smaller driving force. Thus, various sizes of the document lead to varying the load on a driving means for driving the delivery belt, such as a motor.

In the same way, different kinds of documents, in terms of paper quality or thickness for example, will also lead to varying the load on the driving means for the delivery belt.

That is, the larger the document is, the further the document is conveyed to halt beyond the halt position and hence, the document cannot be set accurately in a predetermined position.

SUMMARY OF THE INVENTION

The present invention has been achieved to overcome such drawbacks of the prior art. The primary object of the invention is to provide an automatic document feeder which enables it to set documents precisely on a predetermined position.

According to the present invention, the variation of document conveyance distance mainly due to the variation of the document size is detected by counting pulses which a pulse output means outputs in synchronism with driving of a delivery belt. Based on the detection results, correction will be made on driving of the delivery belt, thereby to place the document edge on a predetermined reference line.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
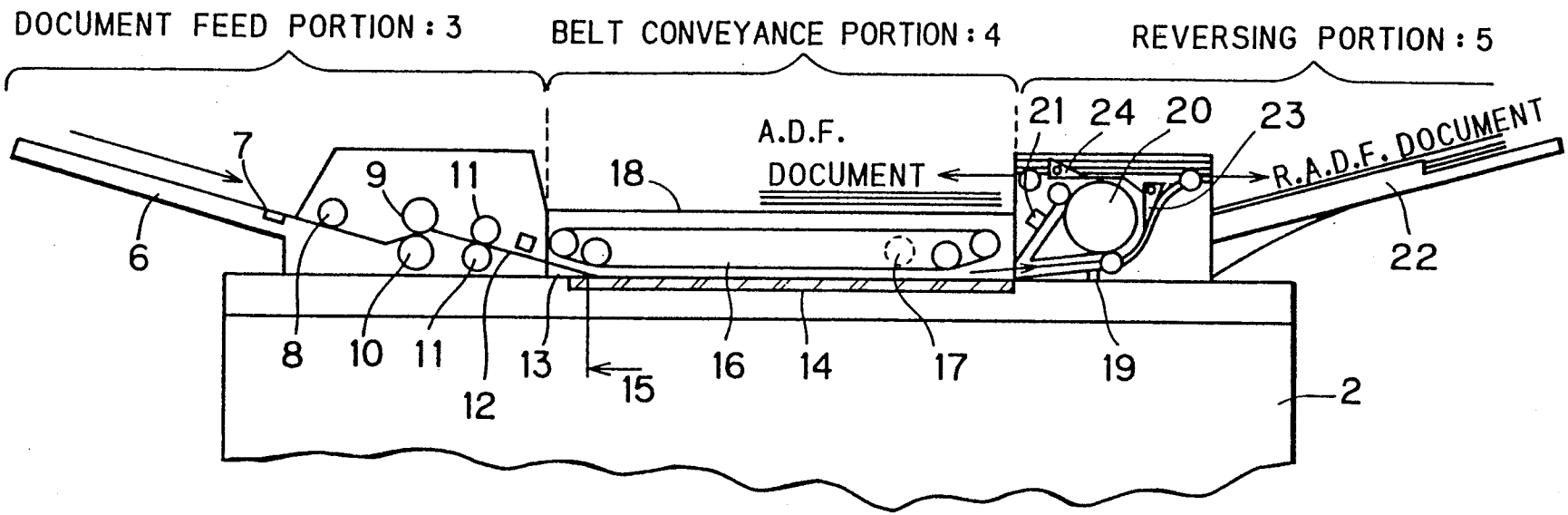
FIG. 1 is a schematic sectional view showing a mechanical architecture of an embodiment of the present invention.

FIG. 1 is a schematic sectional view for illustrating the architecture of an automatic document feeder according to the present invention.

The automatic document feeder 1 is attached to the upper part of the main body of a copying machine 2 and is provided with a document feed portion 3, a belt conveyance portion 4 and a reversing portion 5.

The document feed portion 3 comprises a document set platen 6, a document set detection switch 7 for detecting a document set on the document set platen 6, a delivery roller 8 for delivering the document, a pair of a document feeding roller 9 and a reverse roller 10 for preventing two or more sheets of the document from being fed at a time so that the document may be fed sheet by sheet, a pair of registration rollers 11 for feeding the document to the belt conveyance portion 4 at a predetermined timing, and a document detection sensor 12 for detecting the document fed to the belt conveyance portion.

The belt conveyance portion 4 is provided with a document stopper 13. The document stopper 13 has a protruded edge raised from the surface of a contact glass 14 disposed on the upper side of the main body of the copying machine 2. The protruded edge defines a reference line 15 for setting the document on the contact glass 14.

The belt conveyance portion 4 is further provided with a delivery belt 16 and a pulse output switch 17 for outputting pulses in synchronism with driving of the delivery belt 16. The pulse output switch 17 comprises a rotating disk 171 (see FIG. 2) having multiple slits radially provided and a photointerrupter 172 (see FIG. 2) comprising a pair of a light emitting element and a light receiving element. There is disposed a document discharge tray 18 at the upper portion of the delivery belt 16. The document discharge tray 18 receives documents which are copied either on the surface or on the back side.

The reversing portion 5 is provided with a conveyer switch 19 for detecting the document fed from the belt conveyance portion 4, a document reverse roller 20, a document detecting sensor 21 for detecting the leading edge of the document when the document reversed by the document reverse roller 20 is once again fed to the belt conveyance portion 4, and a document discharge tray 22. The document discharge tray 22 receives a document copied on both sides. The reverse roller 20 is associated with switching claws 23, 24, so that sending of the document is switched by using either of the switching claws 23 and 24.

Figure 2:
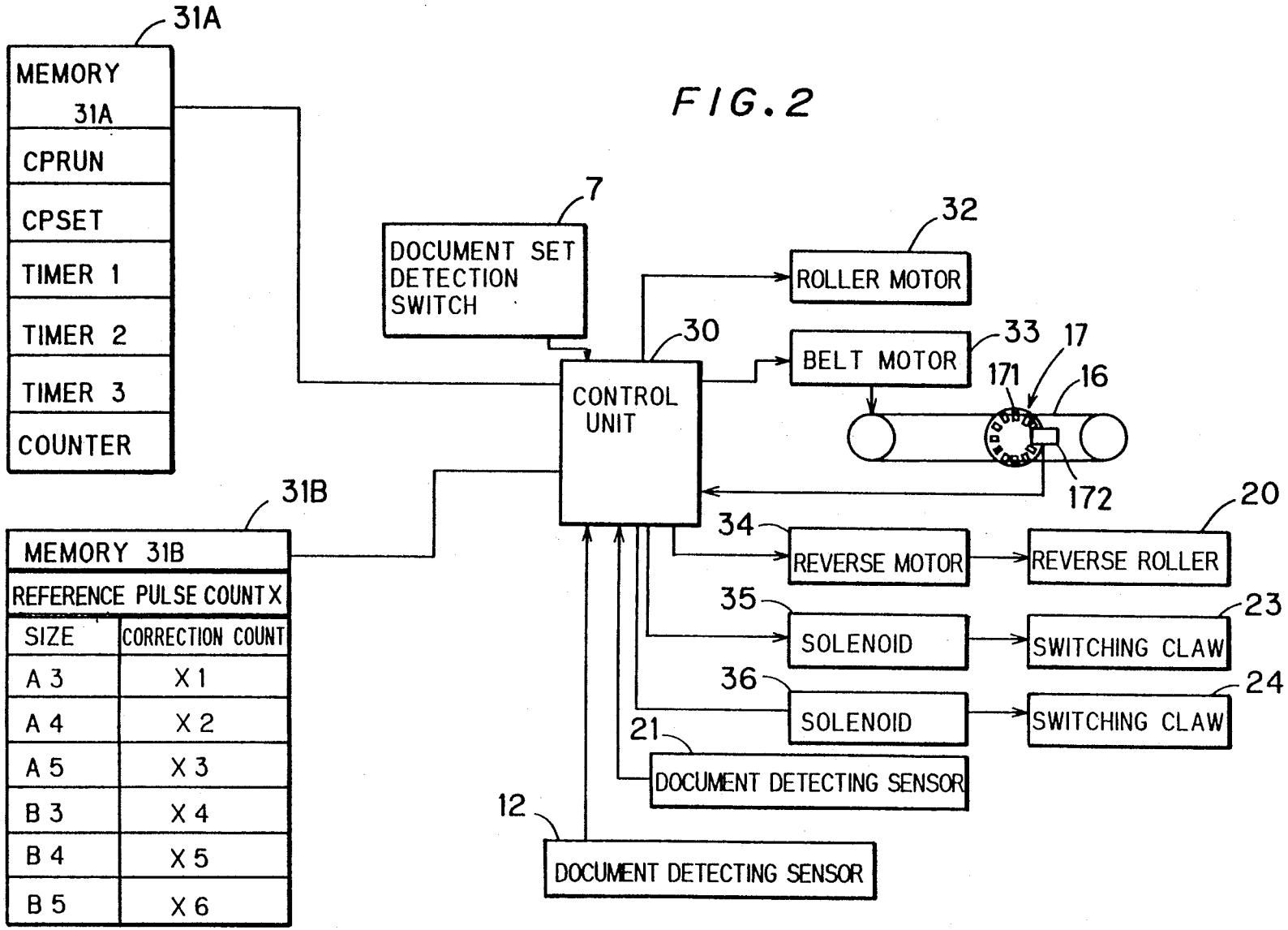
FIG. 2 is a block diagram showing an electric configuration of an embodiment of the present invention.

FIG. 2 is a block diagram showing an electric configuration of an automatic document feeder 1 embodying the present invention.

The feeder 1 is provided with a control unit 30 composed of a microcomputer and the like. The control unit 30 is adapted to receive a detection signal from the document set detection switch 7, detecting signals from the document detecting sensors 12, 21, and a signal from the pulse output switch 17.

The control unit 30 is also connected with memories 31A and 31B. The memory 31A has a data area and such which is necessary for the operations of setting the document brought from the document feed portion 3 in a predetermined position on the contact glass 14. The memory 31B stores data required for the operations of setting the document reversed by the reversing portion 5 once more on the contact glass 14.

More specifically, the memory 31A includes a CPRUN area, a CPSET area, a first timer area, a second timer area, a third timer area and a counter area, which are required for the operations described later.

The memory 31B stores the reference pulse count X and correction pulse counts Xn for every different size of the document. These correction pulses are data obtained through actual measurements by the use of a tester or the like.

Control signals from the control unit 30 are supplied to the delivery roller 8, the document feeding roller 9, a roller motor 32 for driving a pair of the reverse roller 10 and the resist roller 11, a belt motor 33 for driving the delivery belt 16, a reverse motor 34 for turning the document reverse roller 20, a solenoid 35 for switching the switching claw 23 and a solenoid 36 for switching the switching claw 24.

Figure 3:
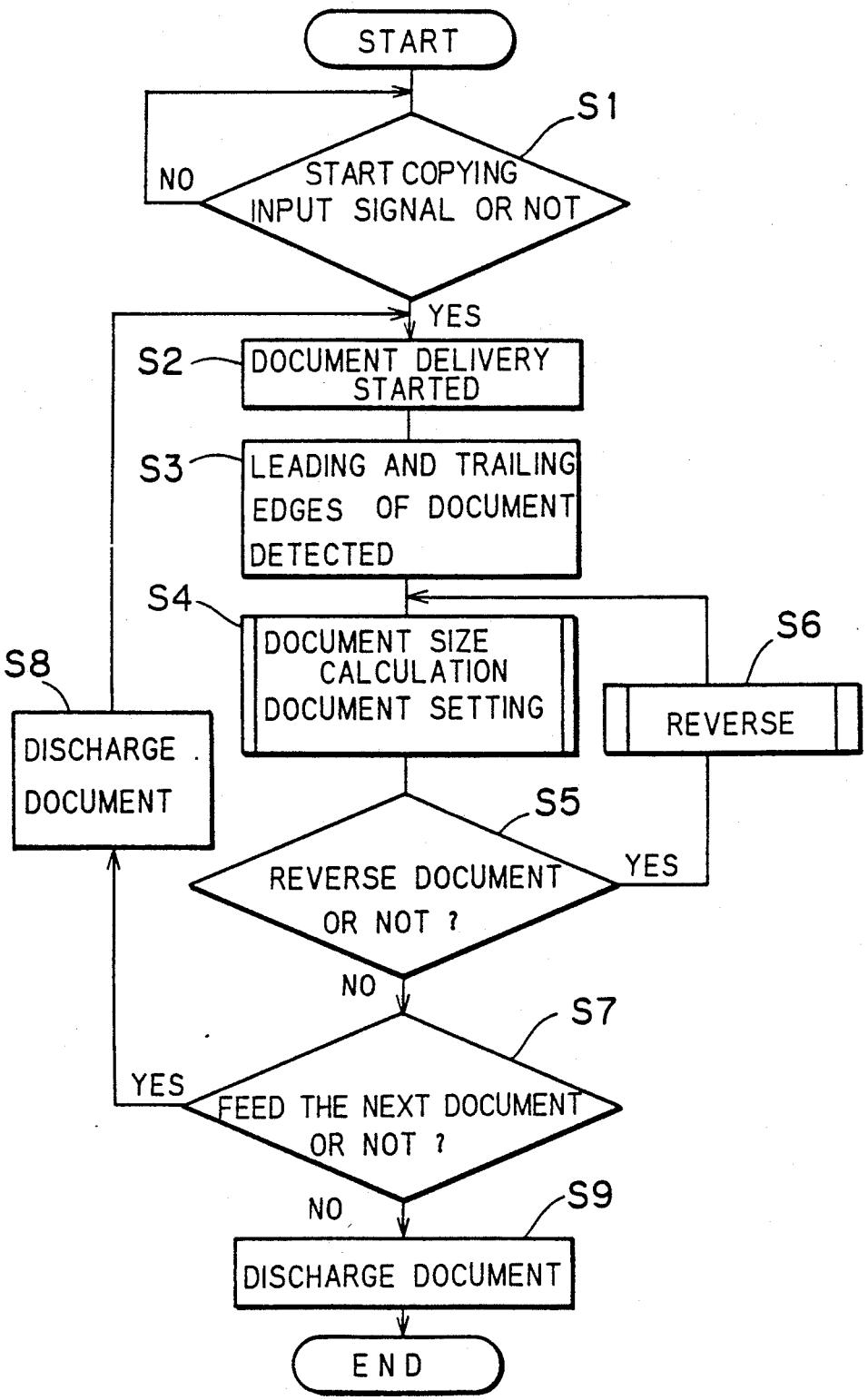
FIG. 3 is a flow chart illustrating the entire course of operations of an embodiment of the present invention.

With reference to FIG. 3, the following description will discuss the entire course of operations of an automatic document feeder embodying the present invention.

When a copy start switch (not shown) on the main body of the copying machine 2 is pressed in, the control unit 30 is supplied with a copy start signal (Step S1).

On perceiving an input of the copy start signal, the control unit 30 actuates the roller motor 32 to start deliverying the document set on the document set platen 6 (step S2).

At this time, the document detecting sensor 12 detects the leading and the trailing edge of the document being delivered and supplies a detecting signal to the control unit 30 (step S3).

According to a document edge detecting signal thus supplied, the control unit 30 calculates the document size, and with a document leading edge detecting signal, the belt motor 33 is actuated to execute the document set operations (step S4).

Then, upon completion of reading the document, whether or not the document is reversed is determined (step S5), and if the document is reversed, the reverse control is performed (step S6).

In case the document is not reversed, the control unit 30 determines whether the next document is fed or not (step S7). If the next document is fed, the belt motor 33 and the reverse motor 34 are actuated, the solenoid 35 and 36 switch the switching claws 23 and 24, and thus the present document is discharged (step S8). Then the operations are repeated from step S2.

In case the next document is not fed, only the document discharging operations are performed (step S9).

Figure 4:
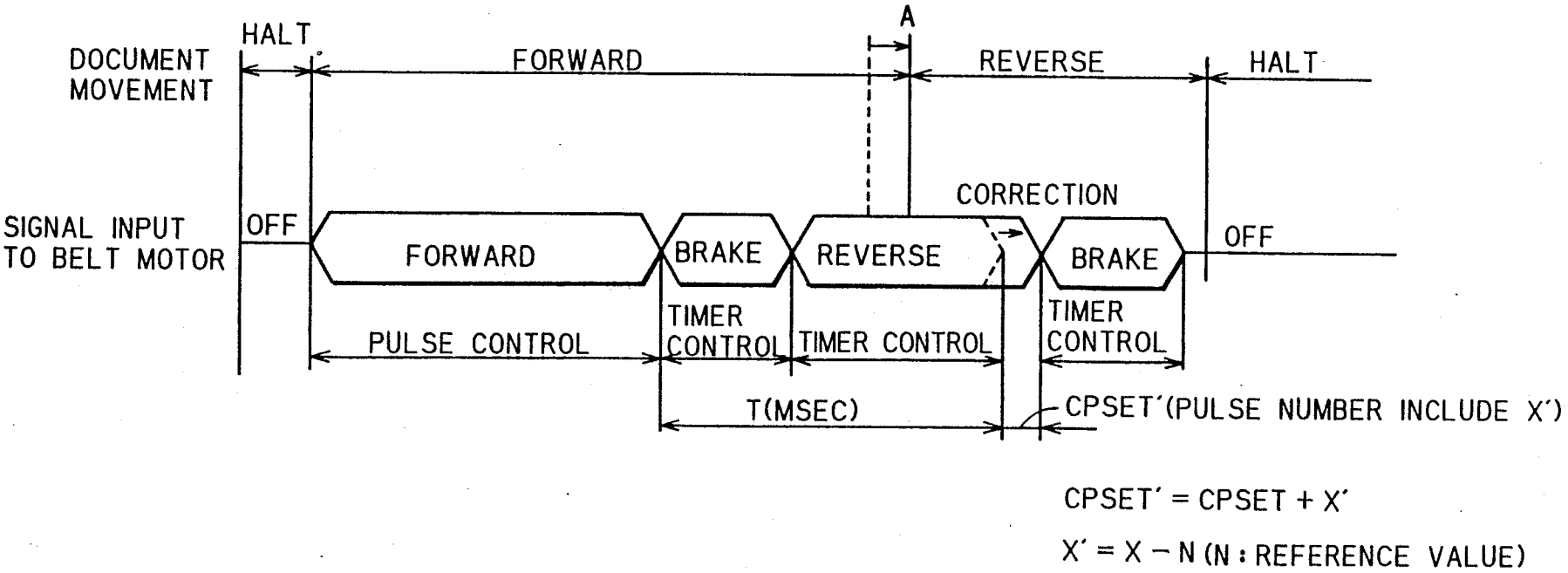
FIG. 4 is a diagram illustrating a timing control to take in and set the document, the control which is characteristic of the control operations of an embodiment of the present invention.
Figure 5:
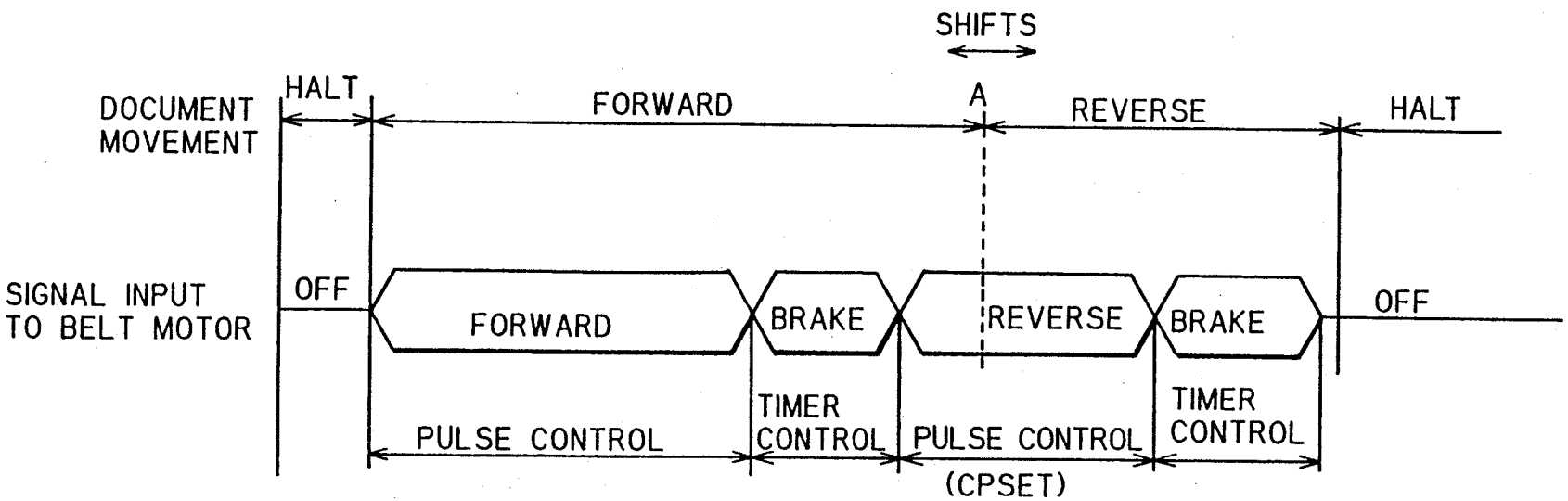
FIG. 5 is a timing diagram which shows conventional generally known control operations for setting documents.

FIG. 4 gives details of driving control of the belt motor 33 in the automatic document feeder 1 having the structure shown in FIGS. 1 and 2. For more clarifying the content of the control operations of FIG. 1, FIG. 5 gives details of driving control of a generally known belt motor as a comparative example.

As shown in FIG. 4, for halting the trailing edge of the document accurately on the reference line 15 when bringing the document from the document feed portion 3 into the belt conveyance portion 4, this embodiment adopts a control method, wherein after the document runs a little bit over a predetermined set position, the belt motor 33 is reversed to switch back the document, thereby to bump the trailing edge of the document against a characteristic portion disposed on the reference line 15.

Figure 6:
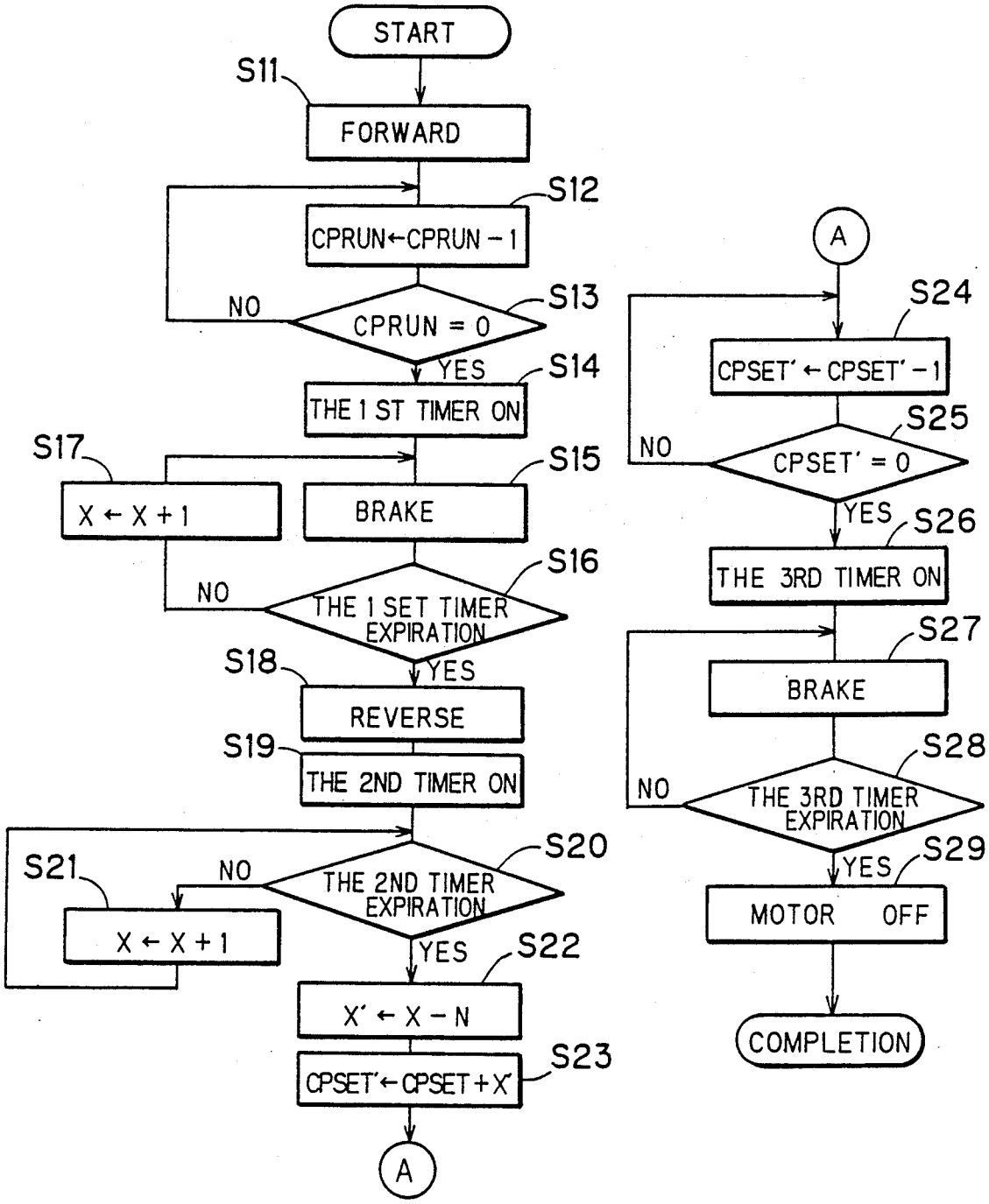
FIG. 6 is a flow chart illustrating control operations for taking in and setting document, the operations which are characteristic of an embodiment of the present invention.

FIG. 6 is a flow chart giving details of the document set operation control executed by the control unit 30. The flow chart of FIG. 6 is for executing the control operations shown in FIG. 4.

Referring to FIGS. 1 to 4, control operations characteristic of the automatic document feeder 1 embodying the present invention will be discussed according to the flow of FIG. 6.

When the document feed portion 3 starts delivering the document and the document fed into the belt conveyance portion 4 is detected by the document detecting sensor 12, a detecting output is sent to the control unit 30. In response to this, the control unit 30 supplies a forward-drive signal to the belt motor 33 (step S11). Then the belt motor 33 is turned forward to make the delivery belt 16 carry the document from the document feed portion 3 toward the reversing portion 5.

In synch with sending the forward-drive signal to the belt motor 33, a count value previously set in the CPRUN area in the memory 31 is decremented (step S12). The belt motor 33 keeps rotating forward until the count value decreases to '0'. When the count value equals to '0' (step S13), the first timer is started (step S14). The first timer measures a predetermined period of time, e.g., 10 msec. Responding to the first timer started, braking on the belt motor 33 is started to continue until the first timer expires (steps S15, 16).

While the control unit 30 is applying braking on the belt motor 33, the pulse count X from the pulse output switch 17 is counted (step S17).

When the first timer expires, a reverse drive signal is sent to the belt motor 33 (step S18), and the second timer is started (step S19). The second timer measures a predetermined period of time, e.g., 25 msec. Until the second timer expires, the control unit 30 continues to count the pulse count X supplied by the pulse output switch 17 (steps S20, S21).

That is, during T msec, the total period of time combining the output span of the braking signal for the belt motor 33 in FIG. 4 and the output span of the reverse drive signal following the above, the pulse output switch 17 continues to output pulses, and the pulse count X thereof is counted.

This embodiment is characterized in that when the reverse drive signal is supplied to the belt motor 33, a period of time for supplying the signal is controlled, and during that time (including the output span of the braking signal as well in this embodiment), pulses are output from the pulse output switch 17 and the pulse count X thereof is counted.

Such a control has the following merits. As shown in FIG. 4, in case after a forward drive signal is output to the belt motor 33, a brake signal is supplied, and then a reverse drive signal is further supplied to the belt motor 33, the delivery belt 16 driven by the belt motor 33 does not halt or reverse without any time lag to each signal sent to the belt motor 33, but halts or reverses with a given time lag. The time lag varies according to the sizes or kinds of the document conveyed by the delivery belt 16. This is because as mentioned before, varied sizes of the document will lead to varying the force required for driving the delivery belt 16.

Therefore, when the direction the delivery belt 16 conveys the document is switched from forward (the first travel direction moving from the document feed portion 3 to the reversing portion 5 in FIG. 1) to reverse (the second travel direction moving from the reversing portion 5 to the document feed portion 3), the halt position A of the trailing edge of the document shifts according to the size or kind of the document.

By such a conventional control as shown in FIG. 5, wherein in supplying the reverse drive signal to the belt motor 33, the signal output was controlled based on the pulse output counts, it was impossible to cope with the shifts of the halt position A of the document. Accordingly, the conventional control could not halt the document so that the trailing edge of the document eventually corresponded with the reference line 15.

To cope with the above problem, the embodiment of the present invention is adapted to control time to supply the reverse drive signal with the belt motor 33, and to measure the distance the delivery belt 16 has actually traveled within a limited period of time by counting the pulses supplied from the pulse output switch 17.

That is, based on the number of pulses output in a given period of time T (the total amount of time combining the first timer and the second timer), the actual distance the delivery belt 16 has traveled, in other words the shifts of the halt position A, can be detected. More specifically, in the case of conveying a small sized document, the contact area of the delivery belt 16 to the contact glass 14 is large, and hence the delivery belt 16 travels shorter distance, shifting the halt position A leftward in FIG. 4. By contrast, the halt position A shifts rightward in the case of conveying a large sized document. The amount of shifts is proportionate to the number of pulses output from the pulse output switch 17.

In step S 22 of FIG. 6, the control unit 30 calculates a difference between the counted pulse count X' and the reference count N set beforehand by means of experiments and the like. The difference representing the correction pulse count X is added to CPSET, thereby to calculate CPSET (step S23).

After the second timer expires, the belt motor 33 continues to receive the reverse drive signal, and meanwhile, each time the belt motor 33 is supplied with the pulse from the pulse output switch 17, the value of CPSET is decremented. When CPSET becomes equal to "0" (steps S24, S25), the third timer is started (step S26).

In this manner, an additional number of pulses for correcting the shifts of the halt position A is counted in when supplying the reverse drive signal to the belt motor 33. Therefore, even if the halt position A varies according to the sizes of the document, the resultant affect can be eliminated. During a period of time set by the third timer, e.g., 20 msec, a brake signal is supplied to the belt motor 33 (steps S27, S28), and the belt motor is turned off (step S29).

In step 12, the second timer is set in such a manner as the pulse counts X are normally larger than the reference value N ($X>N$). Accordingly, when the second timer expires there is always reserved some pulses for the correction, making CPSET' never indicate a minus quantity.

In applying braking in step S15 and step S27, it is more preferable to ground both terminals of the belt motor 33 so as to form a short-circuit than to open the both terminals, because higer braking effort can be obtained by making a short circuit.

Figure 7:
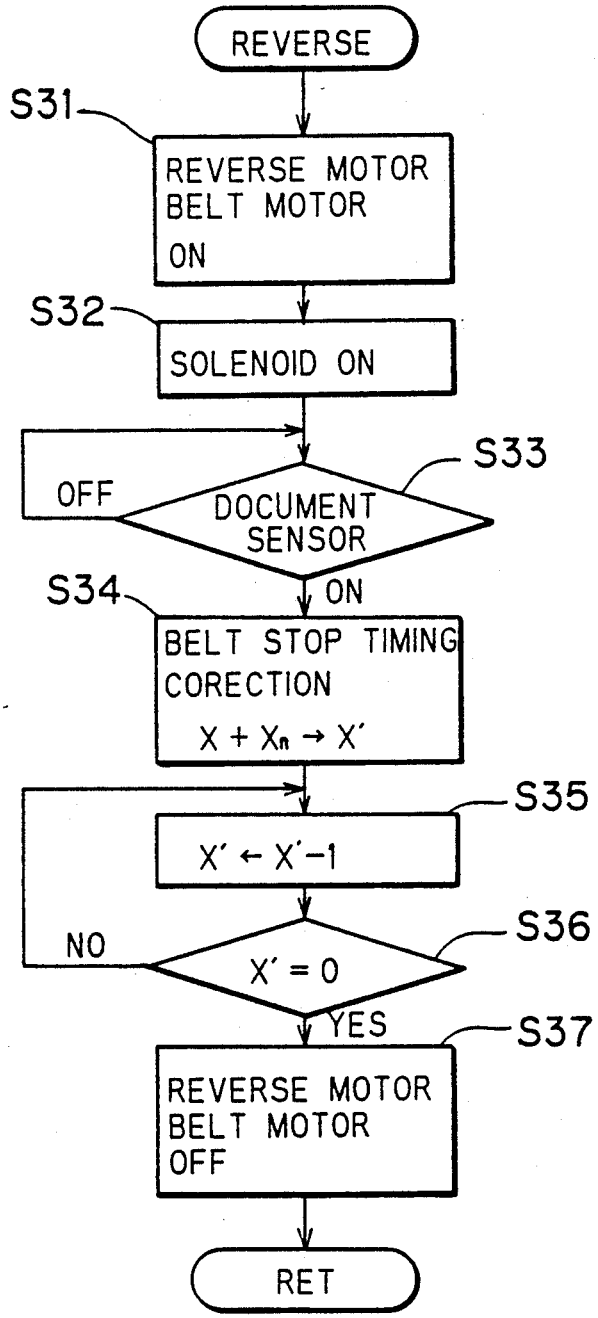
FIG. 7 is a flow chart illustrating reverse control operations in an embodiment of the present invention.

FIG. 7 is a flow chart giving details of reverse control. The following description will discuss the reverse control according to the flow of FIG. 7.

In reverse control, it is adapted that the control unit 30 actuates the belt motor 33 along with the reverse motor 34 (step S31), the solenoids 35 and 36 are turned on to switch the switching claws 23 and 24, and the document delivered from the belt conveyance portion 4 is carried around the reverse roller 20 to be fed again into the belt conveyance portion 4 (step S32).

Then, receiving a document detecting signal from the document detecting sensor 21 (step S33), the control unit corrects timing to stop the belt motor 33 according to the content of the memory 31B (step S34).

Specifically, the correction is executed in the following manner. The reference pulse count necessary for the reverse control is set in advance in the memory 31B. The document with its leading edge detected by the document detecting sensor 21 is carried by the delivery belt 16 as far as its leading edge reaches the reference line 15. The driving amount necessary for the delivery belt 16 to carry the document that distance is converted into the number of pulses output from the pulse output switch 17 and is stored in the memory 31B.

When X represents the pulse count set in the memory, however, the leading edge of the document does not always halt at the reference line 15 even if the delivery belt 16 is driven till the pulse output switch 17 completes outputting X pulses after the document detecting sensor 21 has detected the leading edge of the document. Mainly according to the sizes of the document, the leading edge of the document used to halt before the reference line 15.

In this embodiment, the correction is executed on timing to stop the belt motor 33 in step S34. That is, pulse correction count Xn, which is set in advance for every different size of document and is stored in the memory 31B, is added to the reference pulse count X ($n=1, 2, 3, \ldots$ : Xn represents a value set for every different document size). By the equasion $X'=X+Xn$, the correction pulse count X' is calculated.

After the document detecting sensor 21 detects the leading edge of the document, the belt motor 33 is driven till the corrected pulse count X' is counted (steps S35, S36). When the X' pulses have been counted, the belt motor 33 and the reverse motor 34 are stopped (step S37).

As described above, when the document is reversed, the belt motor is not driven for the reference pulse count X, but the reference count X is corrected to X' according to the document size so as to drive the belt motor 33 for the corrected reference pulse count X'. Accordingly, even if the load on the belt motor 33 varies with every different document size, the driving amount of the belt motor 33 can be adjusted to the variation. Thus, when the document is reversed, it is controlled to halt the document with its leading edge corresponding with the reference line 15.

In the reverse control described above, the correction pulse count Xn which is previously set for every different document size is added to the predetermined reference pulse count X, thereby to drive the belt motor 33 for a corrected pulse count, $X'=X+Xn$. Instead of this, in the same manner as to deliver the document from the document feed portion 3 to the conveyance portion 4, the belt motor 33 can be driven for a predetermined period of time, and the number of pulses output during the predetermined period of time is counted so that a pulse count to correct with can be determined according to the difference between the counted value of the pulses and the reference pulse count whenever necessary.

On the contrary, in the above mentioned document delivery control to deliver the document from the document feed portion 3 to the conveyance portion 4, the same control method with the above mentioned reverse control can be adopted.

While there has been illustrated and described what is at present considered to be a preferred embodiment of the present invention, it will be understood by those skilled in the art that various changes and modifications may be made, and equivalents may be substituted for elements thereof without departing from the true scope of the invention. It is intended that this invention not be limited to the particular embodiment disclosed as the best mode contemplated for carrying out the invention, but that the invention will include all embodiments falling within the scope of the appended claims.

What is claimed is:

1. An automatic document feeder having a document delivery belt, comprising:

pulse output means for outputting pulses in synchronism with the driving of the delivery belt;

belt driving means for driving the delivery belt by a predetermined amount in a first direction and then, driving the delivery belt in a second direction which is opposite to said first direction for a constant time period;

counting means for counting the number of pulses outputted from the pulse output means in the constant time period during which the delivery belt is driven in the second direction;

comparing means for comparing a counted value of the counting means with a predetermined reference value; and additional belt driving means responsive to an output of the comparing means for driving the delivery belt in the second direction until a predetermined number of pulses corresponding to the output of the comparing means have been outputted from the pulse output means.

2. The automatic document feeder according to claim 1, wherein said first direction is such a direction as to take in a document in so as to set a document in a predetermined set position.

3. The automatic document feeder according to claim 1, wherein said pulse output means comprises:

a disc which rotates with the movement of the delivery belt and has a plurality of slits radially provided; and a photosensor provided in opposition to a peripheral portion of said disc and comprising a pair of a light emitting element and a light receiving element.

4. The automatic document feeder according to claim 1, wherein said belt driving means drives the delivery belt in the first direction until a predetermined number of pulses have been outputted from said pulse output means and then, brakes the delivery belt for the first time period and further drives the delivery belt in the second direction for the second time period.

5. An automatic document feeder having a document delivery belt, comprising:

first storing means which stores a conveyance reference amount required to convey a document to a predetermined set position;

second storing means which stores a corrected conveyance amount which differs depending on the document size;

size data output means for outputting size data of the document conveyed;

detecting means for detecting passage of an end of the document as the document is conveyed through a predetermined reference position;

calculating means responsive to an output of the detecting means for reading out the contents of the first storing means and the second storing means on the basis of an output of the size data output means to calculate the amount of conveyance; and belt driving means for driving the delivery belt by the amount of conveyance calculated by the calculating means after the detecting means detects the end of the document.

6. An automatic document feeder having a delivery belt, comprising:

conveying means for setting a document in a predetermined set position and feeding the document set in the set position;

reversing means connected to the conveying means for reversing the document fed from the conveying means to feed the same to the conveying means again;

size data output means for outputting size data of the document conveyed;

detecting means for detecting the document fed to the conveying means from the reversing means;

storing means which stores a conveyance reference amount required to convey the document to a predetermined set position and a corrected conveyance amount which differs depending on the document size;

calculating means responsive to detection of the document by the detecting means for reading out the contents of the storing means on the basis of an output of the size data output means to calculate the conveyance amount required to convey the document of a size indicated by size data outputted from the size data output means; and driving control means for driving the conveying means by the conveyance amount calculated by calculating means.

7. The automatic document feeder according to claim 6, which further comprises pulse output means for outputting pulses in synchronism with driving of the delivery belt, said driving control means detecting and controlling the conveyance amount of the conveying means on the basis of the number of pulses outputted from the pulse output means.

* * * * *